United States Patent [19]

Sato

[11] 4,359,939

[45] Nov. 23, 1982

[54] PRINTING DEVICE

[75] Inventor: Yo Sato, Tokyo, Japan

[73] Assignee: Kabushiki Kaisha Sato Kenkyusho, Japan

[21] Appl. No.: 256,114

[22] Filed: Apr. 21, 1981

[51] Int. Cl.[3] ..... B41K 5/08

[52] U.S. Cl. ..... 101/288; 400/673; 101/72

[58] Field of Search ..... 400/668, 673; 101/141, 101/142, 144, 72, 91, 288–292

[56] References Cited

U.S. PATENT DOCUMENTS

| | | | |
|---|---|---|---|
| 2,374,927 | 5/1945 | Ford | 400/673 |
| 2,471,617 | 5/1949 | Graham | 400/673 |
| 2,652,772 | 9/1953 | Katz | 101/72 |
| 3,120,800 | 2/1964 | Ward | 101/72 |
| 3,330,396 | 7/1967 | James | 400/673 |
| 3,858,508 | 1/1975 | Kaneko et al. | 101/142 |
| 4,200,390 | 4/1980 | Tagashira et al. | 101/142 |
| 4,246,643 | 1/1981 | Hubbard | 101/91 |

FOREIGN PATENT DOCUMENTS

| | | | |
|---|---|---|---|
| 492417 | 11/1975 | Australia . | |
| 575630 | 4/1933 | Fed. Rep. of Germany | 400/673 |

*Primary Examiner*—William Pieprz

*Attorney, Agent, or Firm*—Ostrolenk, Faber, Gerb & Soffen

[57] ABSTRACT

Herein disclosed is such a printing device to be used with a hand labeler or the like that is enabled to prevent a printing medium, such as labels or tags, from being thinly printed and so that averaged clean prints may be made at all times. The printing device includes an actuating lever for bringing a printing head into and out of engagement with a printing medium so that the printing medium may be imprinted. A counting mechanism cooperates with the actuating lever for counting the number of prints. When the counting mechanism counts a predetermined number of prints, a print stopping mechanism stops the operation of the actuating lever. A print returning mechanism releases the stopped condition of the actuating lever so that the printable condition may be restored.

18 Claims, 5 Drawing Figures

PRINTING DEVICE

BACKGROUND OF THE INVENTION

The present invention relates to a printing device which is able to prevent a printing medium, such as labels, tags, or the like from being thinly, i.e. too tightly or unevenly printed to that averaged clean prints may be attained at all times.

In a hand labeler (i.e., a portable label printing and applying machine), for example, according to the prior art, the inking means for the types has been supplied with an initial ink supply that is gradually used up without being replenished. The time for replacement of the inking means, e.g. an ink roller, has been judged exclusively by the density of the prints upon the labels as seen with the naked eye. More specifically, during the printing operation, the ink roller is replaced with a new one when it is recognized with the unaided eye that the prints on the labels have become thinner than normal. Similar replacements are also performed in other printing devices, such as a table type printer.

However, this aforementioned conventional method for determining the time for ink roller replacement may create a serious defect in the POS (which is the abbreviation of "Point-of-Sale") system which has become widespread in recent years. In the POS system, the information displayed in bar codes, or the like, which are printed on labels, or the like, is read out by means of an optical reader and is then processed by means of a computer. The machine readable prints, such as bar codes, must have far greater clarity than prints that are read out with the naked eye. If the prints should not be clear, they cannot be read out by the optical reader and this would invite serious trouble in the smooth practice of the POS system.

SUMMARY OF THE INVENTION

The primary object of the invention is to provide clear, even prints on an imprintable medium.

Another object of the invention is to disable a printing device from printing before the prints cease to be clear and even.

A further object of the invention is to accomplish the foregoing using a non-replenishable ink supply for the printing types.

It is, therefore, an object of the present invention to provide a printing device which prevents an actuating lever of a labeling machine from being operated after a predetermined number of prints have been made, so that an ink roller may be replaced early enough to prevent the prints from becoming thin and to cause the prints to be clear at all times.

The present invention provides a printing device. There are actuating means for bringing a printing head and a printing medium, such as a label, into and out of engagement with each other, thereby to imprint the printing medium. A counting mechanism cooperates with the actuating means for counting the number of prints that have been made. When the counting mechanism counts a predetermined number of prints, a print stopping mechanism stops the operation of the actuating means. A print return mechanism is operable by an operator to release the stopped condition, thereby restoring the actuating means to its imprinting condition.

BRIEF DESCRIPTION OF THE DRAWINGS

Other objects, advantages and features of the present invention will become apparent from the following description taken in conjunction with the accompanying drawings showing one embodiment of the present invention:

FIGS. 2(A) and (B) are perspective views showing a main portion of the printing device of the present invention, as viewed from the lower side thereof and from the side opposite to FIG. 1, wherein FIG. 2(A) shows the inoperative condition of the stopper.

DESCRIPTION OF THE PREFERRED EMBODIMENT

Figure 1:
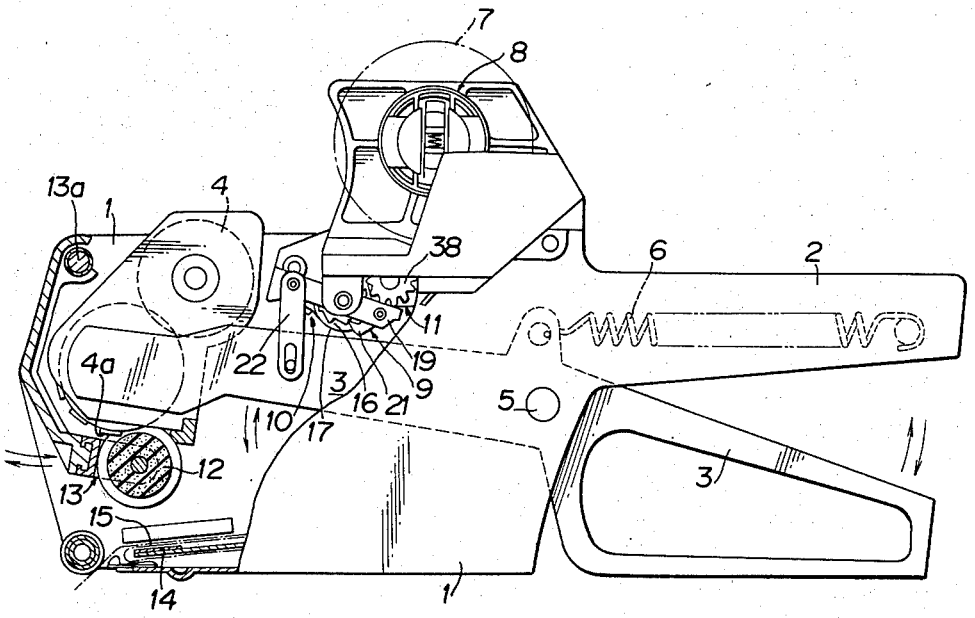
FIG. 1 is a partially cut-away, side elevational view showing a hand labeler which is equipped with a printing device according to the present invention.

The overall construction of a hand labeler is briefly described with reference to FIG. 1. A grip 2 is integrally made to extend from the rear portion of a frame 1, as shown at the right hand side of FIG. 1. An actuating lever 3, carrying a printing head 4 at its front, left hand portion, is hinged to the frame 1 by a pivot pin 5. The actuating lever 3 is biased clockwise at all times by the action of a spring 6 which is held under tension between the upper center portion of the frame 1 and the rear end of the grip 2. The upper end of the frame 1 is provided with a label holder 8 for a rolled, continuous strip of labels 7. Below the label holder 8, there is a counting mechanism 9, a print stopping mechanism 10 and a print returning mechanism 11, all of which are coactive with the actuating lever 3, as described below. An ink supply mechanism 13 is rotatably attached to the front portion of the frame 1 by means of a pivot pin 13*a*. The mechanism 13 is operative to apply ink to the types 4*a* of the printing head 4 through an ink roller 12. The ink supply mechanism comprises a roller that is impregnated with ink, and the supply of ink cannot be replenished while the ink supply mechanism is in the labeler. A platen 14 is disposed below the printing head 4. A continuous strip of labels 15 is unrolled from the rolled continuous strip of labels 7 and is fed onto the platen 14 by a feeding mechanism (not shown) so that the label strip is imprinted by the printing head 4.

The counting mechanism 9, print stopping mechanism 10 and print returning mechanism 11 will now be described with reference to FIGS. 2 to 4.

The counting mechanism 9 comprises a plurality of rotary wheels 17. Each wheel 17 has ten engagement grooves 16 formed on its outer circumference. The wheels 17 are mounted on a shaft 18 carried on the frame 1 and the wheels are in juxtaposition to one another such that they can rotate independently of one another on the shaft. At both end portions of the row of rotary wheels 17, there are hinged to the shaft 18 both of the side plates of a pawl holder 19 which is generally formed into a shape of letter "C". Between both side plates of the pawl holder 19, there is hingedly connected a pawl member 20, which is formed with the same number of pawls 21 as there are rotary wheels 17 and the pawls 21 consecutively protrude with different lengths. The pawl member 20 thus formed is biased by a spring (not shown) in the direction such that the tips of the respective pawls 21 are brought into engagement with the engagement grooves 16 of the respective rotary wheels 17. One of the engagement grooves 16 is made deeper than the others. Since four rotary wheels 17 are provided in this embodiment, the counting mechanism 9 can count a number of imprints having four figures.

One side plate of the pawl holder 19 has its end connected to the actuating lever 3 through a link 22. The outer side of the rotary wheel 17 that is positioned at the opposite side of the row from the aforementioned one side plate is provided with a pair of releasing pins 23 which are arranged at diametrically opposite positions with respect to the shaft 18.

Figure 2:
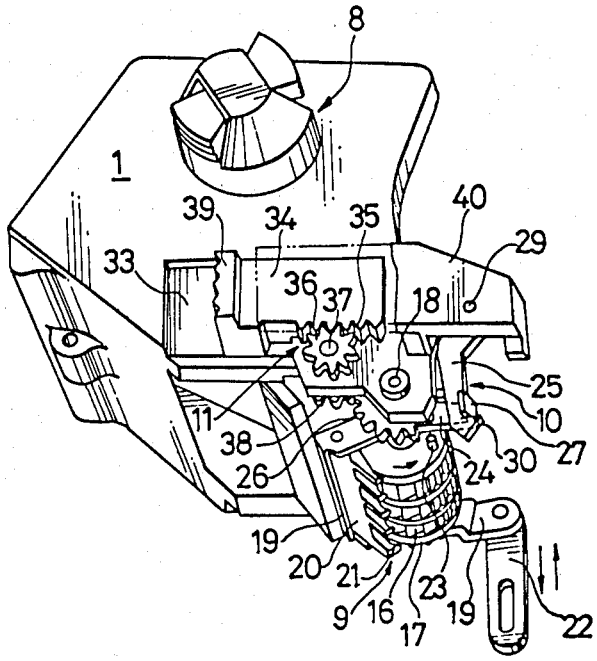
Figure 3:
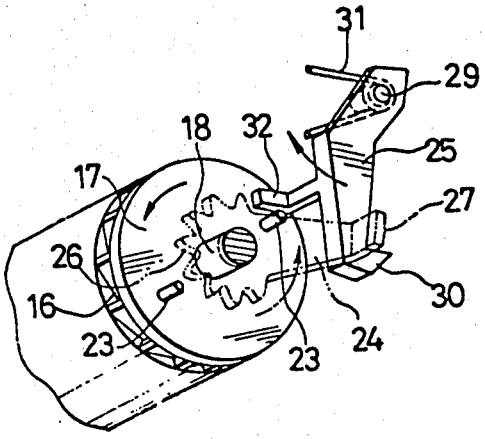
FIG. 3 is a perspective view showing the print stopping mechanism of the printing device of the present invention on an enlarged scale.

As shown in FIG. 3, the print stopping mechanism 10 is comprised of a stopper 24, which is rotatably mounted on the shaft 18, and a retaining member 25 which selectively restrains and releases the stopper 24. The stopper 24 has substantially half its circumference formed with teeth 26. The other half of its circumference protrudes and is tapered to its leading end which is bent to form an L-shaped retaining protrusion 27. The stopper 24 is continuously biased clockwise, as viewed in FIGS. 2 and 3, by a spring 28, shown in FIG. 4, which is mounted on the shaft 18 between the outer side of the pawl holder 19 and the stopper 24.

The retaining member 25 is slender and has one end pivotally mounted on a pin 29 on the frame 1. Its other end is formed with a bent hook 30. The member 25 is biased counter-clockwise, as viewed in FIGS. 2 and 3, by the action of a torsion spring 31 which is wound on the pin 29. The substantially center portion of that retaining member 25 is formed with an L-shaped protrusion 32 which protrudes toward the opposite side from the hook 30, and this allows one of the releasing pins 23 to engage the protrusion 32, as shown in FIG. 3.

Figure 2B:
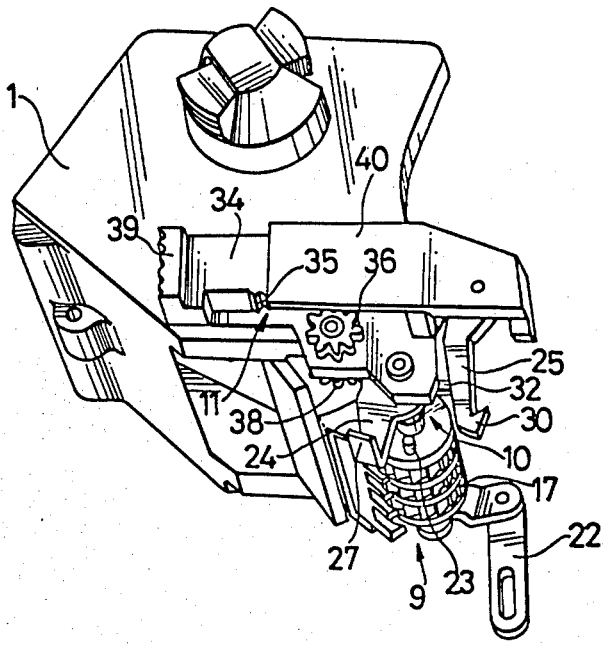
FIG. 2(B) shows the operative condition of the stopper.

The retaining protrusion 27 of the stopper 24 and the hook 30 of the retaining member 25 engage each other under the normal printing condition shown in FIGS. 2(A) and 3, and they disengage under the print-stopped condition shown in FIG. 2(B), until the stopper 24 is rotated about 90 degrees in the clockwise direction.

The print returing mechanism 11 comprises a sliding member 34, which is transversely slidable, left and right in FIG. 2, in a recess 33 formed in the outer wall of the frame 1. A first pinion 36 supported on the frame 1 engages a rack 35 that is provided on the lower side of the sliding member 34. A second pinion 38 is integrally connected to the first pinion 36 through the frame 1 by a shaft 37. The second pinion 38 engages the teeth 26 of the stopper 24 inside the frame 1 so that the stopper 24 can be rotated via the first and second pinions 36 and 38 by means of sliding the sliding member 34 using a knob 39 which is formed at one end of the sliding member 34. There is a cover 40 for the sliding member 34.

The operation of the present invention is now described. Under the normal condition of the hand labeler shown in FIGS. 2(A) and 3, the stopper 24 and the retaining member 25 of the print stopping mechanism 10 restrain each other at their respective retaining portion 27 and hook 30. When the actuating lever 3 shown in FIG. 1 is squeezed toward the grip 2 so that the lever 3 is rotated counter-clockwise, the printing head 4 is moved down, and the types 4*a* at the bottom of the head 4 are supplied with ink by the ink roller 12. The types are then brought into abutment engagement with the label 15 then on the platen 14 so that the label 15 is imprinted. In cooperation with this movement of the lever 3, the pawl holder 19 of the counting mechanism 9 is rotated counter-clockwise (as viewed in FIG. 1) through the link 22 so that the pawl 21 (i.e., the longest one) at the lowermost unit of the pawl member 20 is brought into engagement with the engagement groove 16 of the rotary wheel 17, which is positioned to correspond to said pawl 21.

When the actuating lever 3 is then released, it is rotated clockwise by the tensile force of the spring 6 so that it is returned to the initial position shown in FIG. 1. This feeds the imprinted label 15 out of the hand labeler by the action of the feeding mechanism.

In response to the return motion of that actuating lever 3, the number of prints is counted by the counting mechanism 9. More specifically, by the clockwise return rotation of the actuating lever 3, the pawl holder 19 is also rotated clockwise through the link 22. The rotary wheel 17, i.e., the rotary wheel 17 at the right hand end of FIG. 4, and which has its engagement groove 16 engaging with the pawl 21 at the lowermost unit, is rotated a predetermined angle (e.g., 36 degrees) by the pawl 21. When the printing operation has been performed ten times, that units rotary wheel 17 has rotated one turn, and this rotates the rotary wheel 17 at the next unit, i.e. tens, through a predetermined angle (e.g., 36 degrees), as is similar to a well-known counting mechanism.

Figure 4:
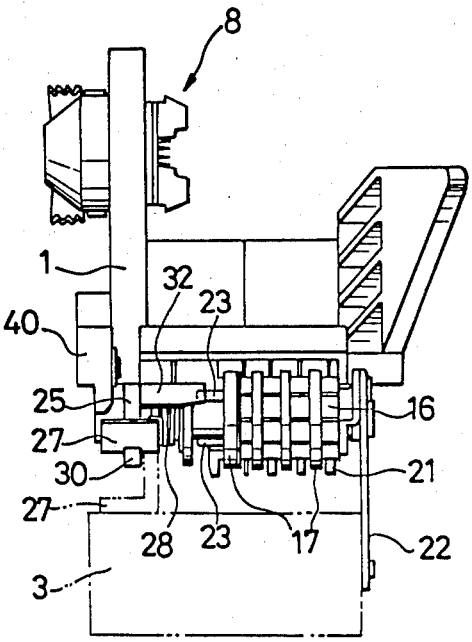
FIG. 4 is a front elevational view showing the essential portion of the printing device.

When the number of prints reaches a predetermined value, e.g., 5000 in the present embodiment, as a result of repetitive squeezing and releasing of the actuating lever 3 so that the rotary wheel 17 at the left hand side of FIG. 4, corresponding to the thousands unit, is rotated 180 degrees, the releasing pin 23 provided at that left hand rotary wheel 17 abuts against and pushes up, on the protrusion 32 of the retaining member 25, and that rotates the retaining member 25 as a whole in the clockwise direction, as viewed in FIGS. 2(A) and 3, which releases the engagement between the hook 30 of the retaining member 25 and the retaining protrusion 27 of the stopper 24. As a result, the stopper 24 is freed to rotate clockwise under the influence of the spring 28. This particular condition takes place when the actuating lever 3 is released, i.e., when the actuating lever 3 has moved clockwise remarkably close to the stopper 24. As a result, the stopper 24 is not rotated fully over its stroke of 90 degrees, but is instead stopped when its edge abuts against the upper side of the actuating lever 3.

When the actuating lever 3 is then squeezed for the next printing operation, it is moved down from the vicinity of and with respect to the stopper 24 so that the stopper 24 is freed to rotate clockwise, as viewed in FIG. 2(B), about 90 degrees from the aforementioned start, retained position, thereby to displace the retaining protrusion 27 to its lowermost position (as indicated at double-dotted lines in FIG. 4). Since the retaining protrusion 27 of the stopper 24 now has its lower side abutting against the upper side of the actuating lever 3, even when the actuating lever 3 is subsequently released, the lever 3 cannot be rotated any more, but it is instead stopped from moving out of its substantially squeezed condition.

Since the predetermined number of prints for actuating that stopper 24 is predetermined in conformity with the expected lifetime, i.e., the time when the imprints start to become thin, of the ink impregnated ink roller 12, the ink roller 12 of the ink supply mechanism 13 should be replaced with a new one when the actuating lever 3 cannot be returned.

With the actuating lever 3 squeezed, the ink supply mechanism 13 has been rotated clockwise, as viewed in FIG. 1, by the printing device 4 so that it is brought into a position at which it protrudes to the front of the labeler. Thus, it is possible to replace the ink roller 12 without any difficulty. Next, the stopper 24 is returned to its initial position, at which the printing operation can be performed, by operation of the print returning mechanism 11. Specifically, if the sliding member 34 is pushed into the cover 40, i.e., to the right, as viewed in FIG. 2(B), the second pinion 38 is rotated clockwise via the rack 35 and the first pinion 36 rotates so that the stopper 24 is rotated counter-clockwise by the teeth 26 which are in engagement with the second pinion 38. After the stopper 24 has been returned rotated about 90 degrees, it is stopped because the retaining protrusion 27 at its leading end is brought into engagement with the hook 30 of the retaining member 25, as shown in FIG. 2(A).

As a result, the actuating lever 3 is freed to rotate clockwise by the action of the spring 6 simultaneously with the rotation of the stopper 24 until the lever 3 is returned to its initial position shown in FIG. 1.

When the squeezing and releasing operations of the actuating lever 3 are subsequently repeated in a similar manner until the number of prints again reaches five thousand, the other releasing pin 23, which is disposed at a symmetrical position with respect to the first discussed releasing pin 23, abuts against and pushes the protrusion 32 of the retaining member 25, thereby to rotate the retaining member 25. As a result, the retention between the hook 30 and the retaining protrusion 27 is again released so that the stopper 24 again becomes operative.

Incidentally, simultaneously with the operation, (i.e., the rotation) of the stopper 24, the sliding member 34 is moved, via the second and first pinions 38 and 36, to the left, from the condition shown in FIG. 2(A) to the condition shown in FIG. 2(B). The reverse movement of the sliding member occurred automatically when a set number of imprints was made.

Moreover, the number of prints prior to the stopper 24 operating can be adjusted by the number and placements of the releasing pins 23. For example, if there is only one releasing pin 23, the stopper 24 operates every ten thousand prints to stop the printing operation.

The present invention should not be limited to the printing device of the type in which the printing head is brought into and out of contact with a fixed platen, as is exemplified in the aforementioned embodiment. It can be applied to the printing device in which the platen is moved relative to the fixed printing head or in which the two are relatively brought into and out of contact with each other. Moreover, the present invention should not be limited to a hand labeler but can be applied to a table type printing device.

As has been described hereinbefore, the printing device according to the present invention is so constructed that the print stopping mechanism operates to stop the printing operation when a predetermined number of prints is reached. As a result, by replacing the ink supply member, such as the ink roller when the labeler has been automatically stopped, the prints upon labels, or the like, can be prevented in advance from becoming thin, so that averaged clear prints can be attained at all times. Therefore, the printing device according to the present invention can be suitable as a printing device for the POS.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A printing device for a hand operated label printing machine, comprising:

actuating means comprising a lever; the printing device comprises a frame with respect to which the lever is movable; a printing head and the actuating means lever being movable to relatively move the printing head and a printing medium to effect imprinting of the printing medium by the printing head by moving the printing head and the printing medium together and apart;

a counting device connected with the actuating means lever for counting the number of movements of the actuating means lever for thereby counting the number of imprints effected;

a print stopping mechanism movable to a first position at which the print stopping mechanism permits the actuating means lever to move for effecting imprinting and movable to a second position at which the print stopping mechanism stops movement of the actuating means lever; the print stopping mechanism being connected to the counting device and the counting device moving the stopping mechanism from the first position of the stopping mechanism to the second position thereof after the counting device counts a certain number of movements of the actuating means;

a print returning mechanism connected with the stopping mechanism for returning the stopping mechanism from the second position to the first position thereof.

2. The printing device of claim 1, further comprising inking means for inking the printing head before an imprint is made by the printing head on the printing medium.

3. The printing device of claim 2, wherein the inking means includes an ink supply which is exhausted by repeated inking of the printing head.

4. The printing device of claim 3, wherein the inking means is detachably attached to the printing device.

5. The printing device of claim 1, wherein the counting device; comprises a shaft supported on the frame and comprises a plurality of rotary wheels mounted for rotation on the shaft, the wheels being connected to rotate in response to actuation of the actuating means for counting actuation by rotating;

the print stopping mechanism including operating means on one of the counting wheels for being moved by rotation of the respective counting wheel to a position which moves the print stopping mechanism to the second position of the print stopping mechanism; at the second position thereof, the print stopping mechanism including means for blocking further movement of the lever.

6. The printing device of claim 5, wherein the printing head is attached to the lever for being moved by the lever.

7. The printing device of claim 5, wherein the wheels are each shaped for receiving a pawl; a respective pawl being connected to the lever and being for engaging at least one respective counting wheel for effecting rotation of the wheel upon movement of the lever.

8. The printing device of claim 5, wherein the stopping mechanism comprises a stopper rotatably mounted on the frame and rotatable between the first and second positions of the stopping mechanism;

a retaining member on the frame and being engageable with the stopper for retaining the stopper in the first position thereof;

biasing means for normally urging the stopper and the retaining member into engagement; the operating means being positioned to engage the retaining member and for moving the retaining member to release engagement with the stopper.

9. The printing device of claim 8 wherein the biasing means normally biases the stopper to the second position, and the retaining member is positioned for normally preventing such biased motion of the stopper.

10. The printing device of claim 9, wherein the returning mechanism engages the stopper for rotating the stopper to the first position thereof as the returning mechanism is moved. . .

11. The printing device of claim 10, wherein the returning mechanism comprises a sliding member slidable with respect to the frame for rotating the stopper to the first position thereof.

12. The printing device of claim 9, wherein the retaining member is pivotally attached to the frame; first means on the stopper engages second means on the retaining member; the biasing means bringing the first and second means into engagement; the retaining member being provided with a further protrusion positioned for being engaged by the operating means upon completion of predetermined rotation of the counting wheels, and such engagement between the operating means and the retaining member protrusion serving to pivot the retaining member to separate the retaining member from the stopper.

13. The printing device of claim 12, wherein the returning mechanism comprises a sliding member slidable with respect to the frame for rotating the stopper to the first position thereof.

14. A printing device comprising:

actuating means including: a printing head and the actuating means being movable for effecting imprinting of an imprintable medium by the printing head; a frame and the actuating means being supported on the frame;

a counting device connected with the actuating means for counting the number of movements of the actuating means for thereby counting the number of imprints effected;

the counting device comprises a shaft supported on the frame and comprises a plurality of rotary wheels mounted for rotation on the shaft, and the wheels being connected to rotate in response to actuation of the actuating means for counting actuations by rotating;

a print stopping mechanism movable to a first position at which the print stopping mechanism permits the actuating means to move for effecting imprinting and movable to a second position at which the print stopping mechanism stops movement of the actuating means;

the print stopping mechanism including operating means on one of the counting wheels for being moved by rotation of the respective counting wheel to a position which moves the print stopping mechanism to the second position of the print stopping mechanism after the counting device counts a certain number of movements of the actuating means;

the stopping mechanism comprising a stopper rotatably mounted on the frame and rotatable between the first and second positions of the stopping mechanism;

a retaining member on the frame and being engageable with the stopper for retaining the stopper in the first position thereof;

biasing means for normally urging the stopper and the retaining member into engagement; the biasing means normally biasing the stopper to the second position, and the retaining member being positioned for normally preventing such biased motion of the stopper; the operating means being positioned to engage the retaining member and for moving the retaining member to release engagement with the stopper;

the stopper having a circumference, one portion of the circumference being toothed and another portion of the circumference supporting and defining a protrusion extending outward from the rotation axis of the stopper; the retaining member being pivotally attached to the frame, and away from the pivot attachment of the retaining member, the retaining member including a hook for engaging the protrusion of the stopper; the biasing means bringing the protrusion of the stopper and the hook of the retaining member into engagement; the retaining member being provided with a further protrusion positioned for being engaged by the operating means upon completion of predetermined rotation of the counting wheels, and such engagement between the operating means and the retaining member protrusion serving to pivot the retaining member to separate the retaining member from the stopper;

a print returning mechanism connected with the stopping mechanism for returning the stopping mechanism from the second position to the first position thereof.

15. The printing device of claim 14, wherein the stopper is rotatably mounted on the shaft of the counting wheels.

16. A printing device comprising:

actuating means including: a printing head and the actuating means being movable for effecting imprinting of an imprintable medium by the printing head; a frame and the actuating means being supported on the frame;

a counting device connected with the actuating means for counting the number of movements of the actuating means for thereby counting the number of imprints effected;

the counting device comprises a shaft supported on the frame and comprises a plurality of rotary wheels mounted for rotation on the shaft, and the wheels being connected to rotate in response to actuation of the actuating means for counting actuations by rotating;

a print stopping mechanism movable to a first position at which the print stopping mechanism permits the actuating means to move for effecting imprinting and movable to a second position at which the print stopping mechanism stops movement of the actuating means;

the print stopping mechanism including operating means on one of the counting wheels for being moved by rotation of the respective counting wheel to a position which moves the print stopping mechanism to the second position of the print stopping mechanism after the counting device counts a certain number of movements of the actuating means;

the stopping mechanism comprising a stopper rotatably mounted on the frame and rotatable between the first and second positions of the stopping mechanism;

a retaining member on the frame and being engageable with the stopper for retaining the stopper in the first position thereof;

biasing means for normally urging the stopper and the retaining member into engagement; the biasing means normally biasing the stopper to the second position, and the retaining member being positioned for normally preventing such biased motion of the stopper; the operating means being positioned to engage the retaining member and for moving the retaining member to release engagement with the stopper;

a print returning mechanism connected with the stopping mechanism for returning the stopping mechanism from the second position to the first position thereof;

the returning mechanism engaging the stopper for rotating the stopper to the first position thereof as the returning mechanism is moved;

the returning mechanism comprising a sliding member slidable with respect to the frame for rotating the stopper to the first position thereof;

pinion means joining the sliding member and the stopper, such that sliding of the sliding member in one direction rotates the pinion means for rotating the stopper to the first position thereof at which there is reengagement of the stopper with the retaining member.

17. A printing device comprising:

actuating means including: a printing head and the actuating means being movable for effecting imprinting of an imprintable medium by the printing head; a frame and the actuating means being supported on the frame;

a counting device connected with the actuating means for counting the number of movements of the actuating means for thereby counting the number of imprints effected;

the counting device comprises a shaft supported on the frame and comprises a plurality of rotary wheels mounted for rotation on the shaft, and the wheels being connected to rotate in response to actuation of the actuating means for counting actuations by rotating;

a print stopping mechanism movable to a first position at which the print stopping mechanism permits the actuating means to move for effecting imprinting and movable to a second position at which the print stopping mechanism stops movement of the actuating means;

the print stopping mechanism including operating means on one of the counting wheels for being moved by rotation of the respective counting wheel to a position which moves the print stopping mechanism to the second position of the print stopping mechanism after the counting device counts a certain number of movements of the actuating means;

the stopping mechanism comprising a stopper rotatably mounted on the frame and rotatable between the first and second positions of the stopping mechanism;

a retaining member on the frame and being engageable with the stopper for retaining the stopper in the first position thereof;

biasing means for normally urging the stopper and the retaining member into engagement; the biasing means normally biasing the stopper to the second position, and the retaining member being positioned for normally preventing such biased motion of the stopper; the operating means being positioned to engage the retaining member and for moving the retaining member to release engagement with the stopper;

the retaining member being pivotally attached to the frame; first means on the stopper engaging second means on the retaining member; the biasing means bringing the first and second means into engagement; the retaining member being provided with a further protrusion positioned for being engaged by the operating means upon completion of the predetermined rotation of the counting wheels, and such engagement between the operating means and the retaining member protrusion serving to pivot the retaining member to separate the retaining member from the support;

a print returning mechanism connected with the stopping mechanism for returning the stopping mechanism from the second position to the first position thereof;

the returning mechanism comprising a sliding member slidable with respect to the frame for rotating the stopper to the first position thereof;

pinion means joining the sliding member and the stopper, such that sliding of the sliding member in one direction rotates the pinion means for rotating the stopper to the first position thereof at which there is reengagement of the stopper with the retaining member.

18. The printing device of either of claims 9 or 12, wherein the stopper is rotatably mounted on the shaft of the counting wheels.

* * * * *